US006491329B1

(12) United States Patent
Smith

(10) Patent No.: US 6,491,329 B1
(45) Date of Patent: Dec. 10, 2002

(54) WORK SUPPORT ATTACHMENT FOR HOISTS

(76) Inventor: Jimmy A. Smith, 4205 Big Oak Cir., Valdosta, GA (US) 31602

( * ) Notice: Subject to any disclaimer, the term of this patent is extended or adjusted under 35 U.S.C. 154(b) by 0 days.

(21) Appl. No.: 09/655,266

(22) Filed: Sep. 5, 2000

Related U.S. Application Data

(60) Provisional application No. 60/152,583, filed on Sep. 7, 1999.

(51) Int. Cl.[7] ..... B66C 1/34

(52) U.S. Cl. ..... 294/1.1; 294/82.1; 403/78; 403/165

(58) Field of Search ..... 294/1.1, 82.1, 294/82.11, 82.12, 82.15; 403/78, 164, 165

(56) References Cited

U.S. PATENT DOCUMENTS

| | | | | | |
|---|---|---|---|---|---|
| 1,657,260 | A | * | 1/1928 | Holt | 294/82.1 |
| 2,215,431 | A | | 3/1940 | Sloan et al. | |
| 2,283,354 | A | * | 5/1942 | Dalzell | 294/82.1 |
| 2,625,005 | A | * | 1/1953 | Myers | 294/82.1 |
| 2,651,533 | A | * | 9/1953 | Miller | 294/82.1 |
| 3,995,903 | A | | 12/1976 | Ernst | |
| 4,308,419 | A | * | 12/1981 | Fredriksson | 403/78 |
| 4,669,907 | A | * | 6/1987 | Patton | 294/82.1 |
| 4,708,382 | A | * | 11/1987 | LaCount | 294/82.1 |
| 5,671,960 | A | | 9/1997 | Chyz | |
| 5,772,350 | A | * | 6/1998 | Ferguson et al. | 403/78 |
| 5,800,000 | A | | 9/1998 | Shockley | |

* cited by examiner

*Primary Examiner*—Dean J. Kramer
(74) *Attorney, Agent, or Firm*—Carnes Cona

(57) ABSTRACT

The present invention is a work support attachment for use with conventional hoists. The work support attachment comprises a top portion, a middle portion, and a lower portion. The top portion is secured to the conventional hoist device and the lower portion is adapted to be removably receiving an attaching element, such as a hook. This lower portion can rotate freely.

12 Claims, 3 Drawing Sheets

WORK SUPPORT ATTACHMENT FOR HOISTS

This is a utility Patent Application for Provisionally File Application No. 60/152,583 filed on Sep. 7, 1999.

BACKGROUND OF THE INVENTION

1. Field of the Invention

The present invention relates generally to a work support attachment for hoisting units and more particularly to a support attachment for hoists which enables a lifted object or load, such as an engine or the like, to be lifted and during the lifting process will prevent the item from twisting, shifting or spinning, such as during the removal or replacement of the engine to a vehicle, yet enables the user to freely rotated the item when in a raised and fixed position.

2. Description of the Prior Art

Hoists and devices used with conventional hoists have been around for used. As is known, hoists are extremely helpful in lifting and supporting extremely heavy items or loads, such as engines, industrial items and the like. Though the years, devices and been developed to enhance the conventional hoists to provide a final product that increases the safety of the use of the hoists as well as provide an environment which will increase the work efficiency when the hoist is utilized.

For example in U.S. Pat. No. 2,215,431 issued to Sloan et al there is disclosed a device to be used in combination with a conventional hoists. This device is specifically used for lowering pieces of work and placing them in position for the operation of machine tools. Thereby providing a device geared at safety as well as efficiency.

In U.S. Pat. No. 3,995,903 to Ernst there is disclosed an engine lift tool connected to a lift hoist via brackets and a yoke member. This engine lift tool tools is constructed in such a way that its parts are inseparable from the other. Thereby providing a device that reduces time generally associated with engine lift tools of the type including lift bails or brackets.

In U.S. Pat. No. 5,671,960 issued to Chyz there is disclosed an engine balancing lifting device consisting of a main beam and two cross beams. The purpose of this device is to lift and install engines.

U.S. Pat. No. 5,800,000 issued to Shockley discloses a load adjusting device for use with a hoisting unit. This device is designed to orientate the object for proper handling, installing and use.

None of these devices, however, provides a device which enables a load to be hoisted without twisting, spinning, shifting. In addition a device is needed that will allow for a smooth rotation of the lifted item, when the hoist is in a fixed and upright position. Such a unit will allow for loads to be safely removed and replaced in the appropriate machinery, as well as enable the load to be upright and observed at all and any angle.

As will be seen, the present invention achieves its intended purposes, objectives and advantages by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a work support attachment that is designed and configured to be used with a conventional hoisting unit. This apparatus is ideally suited for lifting and/or raising any large bulky machine item, such as engines or the like, and will enable a load to be hoisted in a safer manner by alleviating the twisting, turning and spinning of the item being held, such as a engine or the like. In addition, the present invention will offer a means of rotation, which will allow for the item to be rotated when desired, and thus provide the user to rotate the item held, so as to be adequately viewed and/or serviced.

To enable such an arrangement, the work support attachment of the present invention is comprised of a top portion, middle portion and a lower portion. The top portion of the present invention contains an attaching/engagement member for receiving a lifting mechanism, such as a chain from the conventional hoist. Generally, this attaching/engagement member comprises two elongated flanges disposed parallel to each for innately forming a U-shaped configuration. Extending though the flanges are alignable holes that will removable receive a pin or the like. Thus in use, the lifting mechanism, such as chain link, is placed between the flanges. The pin is inserted into the holes and through the chain link. The pin is locked into place via conventional means, such as the use of the cotter pin or the like. Thereby, providing for the work support attachment to be secured to the conventional hoist.

The middle portion of the instant invention includes a hollow cylindrical body. This hollow cylindrical body houses a conventional bearing. The conventional bearing will receive a shank that extends outwardly and downwardly from the hollow cylindrical body. This outward extension provides for the lower portion of the present invention.

Secured to the shank, at the lower portion is an engagement member. This engagement member is preferably a hook. This hook will act as a hook generally used and located on conventional hoists units, and thus will receive the particular load. Thereby, when lifting the load will remain stationary. When the lifting process is terminated, and the hoisting unit ceases operation, the load will remain stationary. At this point, the bearing will permit for the shank to turn freely (360 degrees).

The top portion is secured to the cylindrical body via conventional means. This attachment is such that it will restrict the upward movement of the shank. The shank is machined to connect to the lower portion engagement member.

Accordingly, it is the object of the present invention to provide a work support attachment that is designed and configured to be used with a conventional hoisting unit which will overcome the deficiencies, shortcomings, and drawbacks of the prior hoisting attachments and methods thereof, and one that can easily and readily be used and installed in conventional hoisting units.

Still another object of the present invention is to provide a work support attachment used with a conventional hoisting unit that will prevent twisting of the load, such as an engine or the like, during the installation or removal process.

A further object of the present invention is to provide a work support attachment to be used with a conventional hoisting unit that offers a safe means of lifting a load and one which will inherently eliminate damage to lifted items and its components, during the hoisting process.

Still another object of the instant invention is to provide a means that will enable the lifted item to be turn at any desired location thereby expediting access to all sides of the item lifted, such as a motor engine or the like.

Yet a further object of the present invention is to provide for a work support attachment to be used with a conventional hoisting unit that will assist in machinery repairs, consequently providing an expeditious and efficient process for removing, viewing, repairing and installed the particular item.

A final object of the present invention, to be specifically enumerated herein, is to provide a work support attachment that is designed and configured to be used with a conventional hoisting unit in accordance with the preceding objects and which will conform to conventional forms of manufacture, be of simple construction and easy to use so as to provide a device that would be economically feasible, long lasting and relatively trouble free in operation.

Although there have been many engine hoist devices, none of the inventions address the need of having a unit that will enable safe hoisting as well as adequate rotational possibility. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings. dr

BRIEF DESCRIPTION OF THE DRAWINGS

Similar reference numerals refer to similar parts throughout the several views of the drawings.

DESCRIPTION OF THE PREFERRED EMBODIMENT

Figure 1:
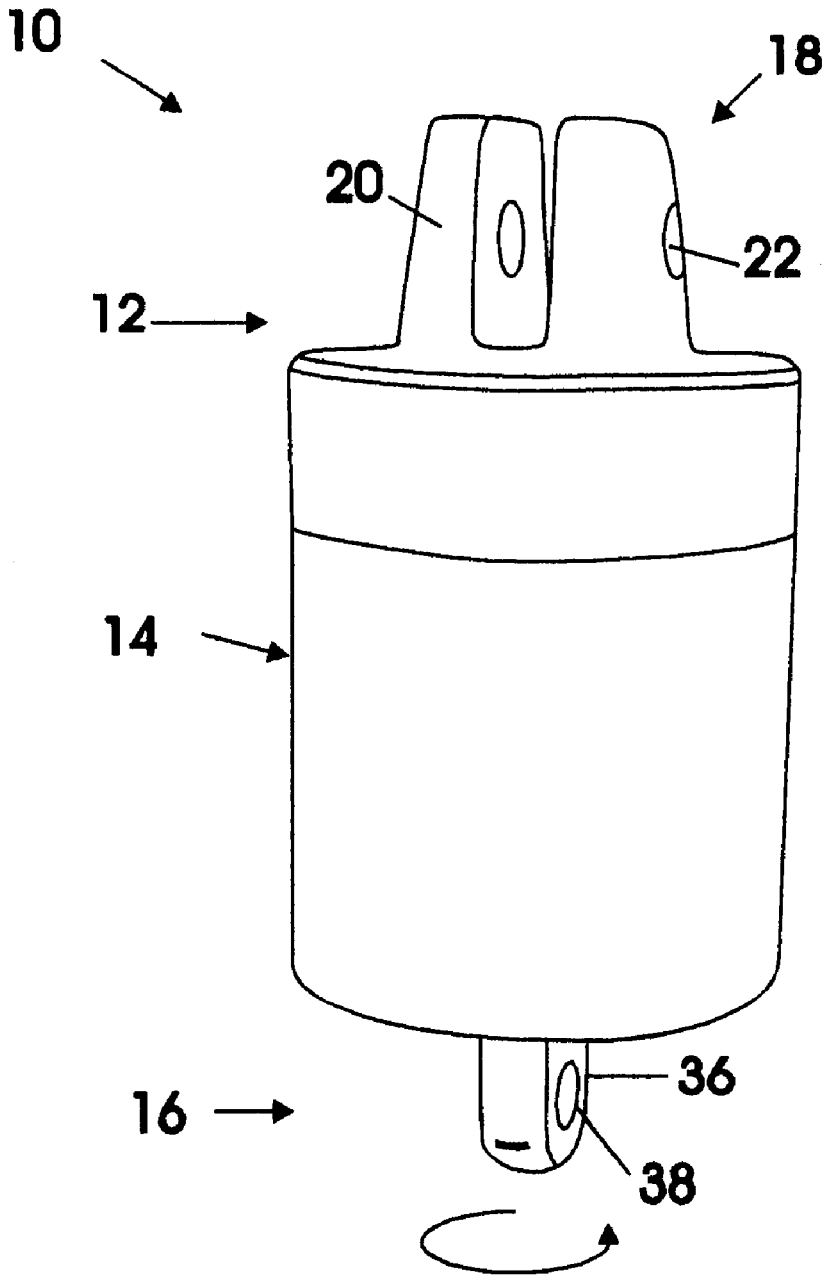
FIG. 1 is a perspective view of the work support attachment device of the present invention.

The present invention relates to a work support attachment that is designed and configured to be used with a conventional hoisting unit. This device of the present invention will replace the conventional hook of hoisting unit, so as to enhance and increase the versatility of conventional hoisting devices. Alternatively, the present invention can be secured to the existing hook of the conventional hoisting unit.

When in use, the present invention will enable an item, such as an engine, to be lifted and/or lowered to any desired location. During installation and/or removal, the item held by the present invention will not twist, shift or spin, thereby providing an item which can be adequately oriented and one that will increase safety when working on large, heavy and bulky items, such as an engine. In addition, the present invention will allow complete rotation (360 degrees) when the item is attached thereto. Thereby rendering a unit that will allow the user to turn the item held at any desired location. Such a configuration will intrinsically expedite access to all sides of the item lifted, such as a motor engine or the like. Ultimately providing a work support attachment to be used with a conventional hoisting unit that will assist in machinery repairs, (such as an engine) innately providing an expeditious and efficient process for removing, viewing, repairing and installed the particular item.

With reference to the drawings, in particular to FIGS. 1–4 thereof, a work support attachment, generally denoted by reference numeral 10 will be described.

As seen in FIGS. 1–4 the work support attachment 10 is comprised of a top portion 12, a middle portion 14 and a lower portion 16. The top portion is an end cap that is secured to the middle portion.

Exteriorly located and extending outwardly from the end cap or top portion is an attaching/engagement member 18. This attaching/engagement member 18 comprises two elongated flanges 20 disposed parallel to each for innately forming a U-shaped configuration. This U-shape configuration will inherently form a gap. Extending though the flanges are alignable holes 22 that will removable receive a pin or the like.

In use, this top portion will be secured to the lifting mechanism of a conventional hoisting unit. Thus the gap formed by the elongated flanges will receive the lifting mechanism, such as a link of a chain of the conventional hoisting device. A conventional pin 24 will be inserted into the holes 22 and through the link of the chain. The pin 24 is locked into place via conventional means, such as the use of the cotter pin (not illustrated) or the like. As seen, a cotter pin can be located within the channel extending through the pin. The channel of pin 24 is shown in FIG. 4, but not illustrated.

Figure 4:
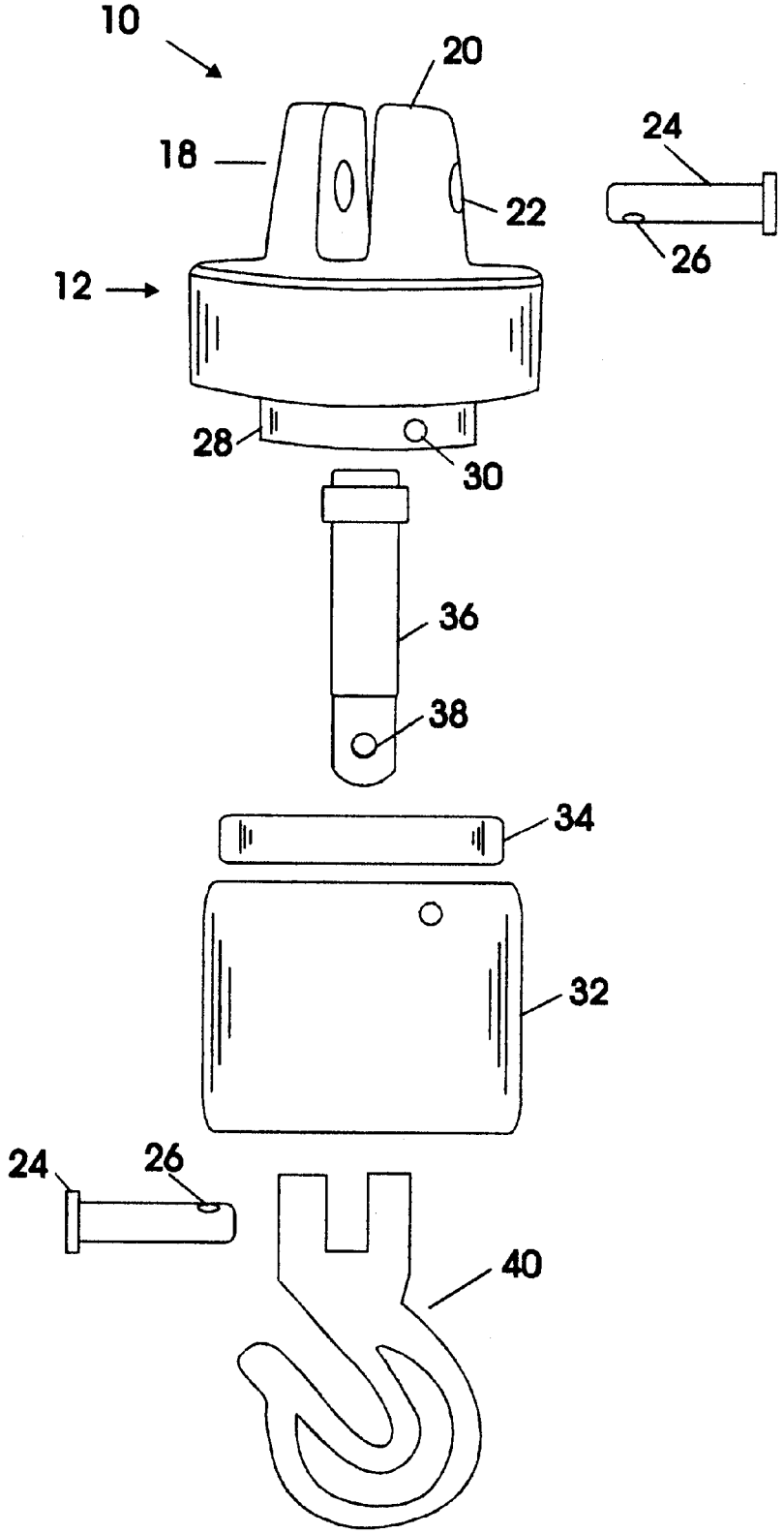
FIG. 4 is an exploded perspective view of the work support attachment device of the present invention.

Located oppositely from the attaching/engagement member 18, as seen in FIG. 4, is a flange 28. Extending partially through this flange 28 is channel 30. This channel is adapted to receive a pin for enabling the end cap or top portion 12 to be secured to the middle portion 14.

Figure 2:
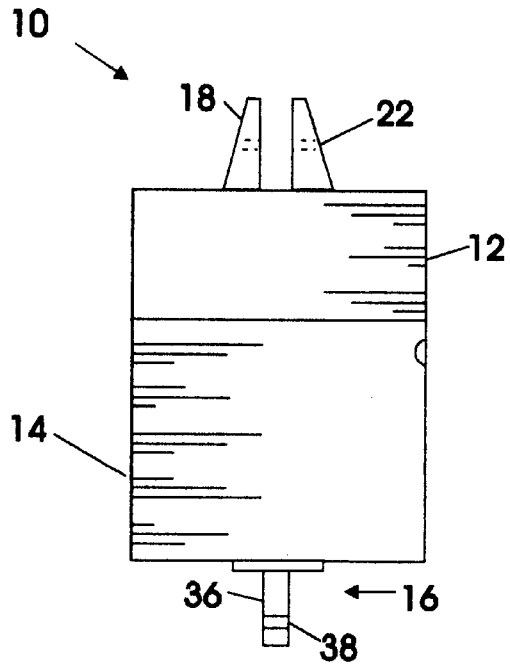
FIG. 2 is a front planar view of the work support attachment device of the present invention.
Figure 3:
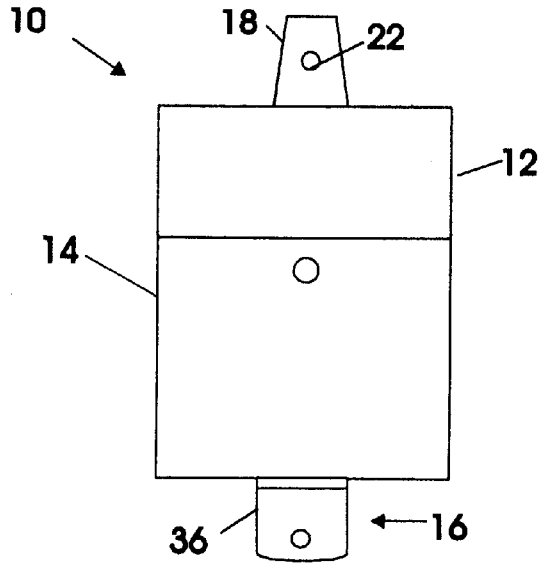
FIG. 3 is a side planar view of the work support attachment device of the present invention.

The middle portion is secured to the top portion, and includes a hollow cylindrical body 32, having an open top and an enclosed bottom. An aperture, illustrated in FIG. 3, but not labeled, extends through the circumferential wall of the hollow housing. Extending through the enclosed bottom is an aperture. This hollow cylindrical body, as seen in FIG. 4, houses a conventional bearing 34. The conventional bearing 34 will receive a shank 36. When assembled, as seen in FIGS. 1–3, the shank will pass the aperture in the hollow cylindrical body to provide for the shank 36 to extend outwardly and downwardly from the hollow cylindrical body 32. This outward extension provides for the lower portion 16 of the present invention.

Assembling the unit occurs by pressing the bearing 34 into the hollow housing. This will provide for the bearing to be snug within the housing. The shank is then inserted into the housing, through the bearing and through the aperture of the housing. The flange 28 of the end cap is placed into the open top of the cylinder. Once held in place, the channel 30 of the flange and the aperture located in the circumfercial wall of the cylinder are aligned and a pin is inserted therein. Once inserted the invention is ready for use.

Since the shank extends through the bearings 34, it can freely rotate. Thus it is seen that the lower portion 16 can rotate freely about the middle portion, as seen by referenced arrow in FIG. 1.

The shank includes a second end as seen in FIGS. 1–4 that includes a receiving device 38. This receiving device 38 is an aperture that is designed and configured to receive a conventional holding device, such as a hook 40, as shown in FIG. 4. This holding device will act as a hook generally used and located on conventional hoists units, and thus will receive the particular load. Thereby, when lifting the load will remain stationary. When the lifting process is terminated, and the hoisting unit ceases operation, the load will remain stationary. At this point, the bearing will permit for the shank to turn freely (360 degrees).

Accordingly, to secure a conventional holding device to the receiving device, as seen in FIG. 4, a pin 24 is inserted through the holding device, shown in this figure as a hook, and the aperture 38. Once inserted therethrough, a cotter pin (not illustrated) is inserted into the aperture 26 of the pin. Thereby providing for the holding device to be secured to the present invention.

To utilize the present invention, the user first attaching the top portion 12 to the holding mechanism of the conventional hoisting unit. A hook can be secured to this top portion so as to allow for the hook to attach itself to the conventional hoist. Optionally, this top portion can be secured to a chain or the like of the conventional hoisting unit.

Once secured, the holding device is secured to the lower portion 16 of the present invention. This holding device can be a conventional grab or sling hook, which has been used to produce favorable results. Once secured, the holding device will be attached to the desired object. The desired object can be lifted and/or lowered safely and adequately. Due to the design and configuration of the present invention, the item hoisted does not twist, turn or spin. In addition, due to the structure of the middle portion and the lower portion, the shank will allow for the held object to be rotated, so as to be adequately viewed. Thus providing a final product that offers safety, versatility and comfort for the user, so as to permit the user to quickly, efficiently, and adequate remove, repair and install the held item as desired.

While the invention has been particularly shown and described with reference to an embodiment thereof, it will be understood by those skilled in the art that various changes in form and detail may be made without departing from the spirit and scope of the invention.

I claim:

1. An attachment device for use with a hoisting unit, said attachment device comprising:

a top portion;

said top portion constitutes an end cap and extending upwardly from said end cap are a pair of elongated flanges disposed parallel and forming a U-shaped configuration forming a centrally located gap between said pair of elongated flanges;

each flange includes an alignable aperture that is adapted to receive a removable locking pin;

extending downwardly from said end cap, and being smaller in size than said end cap, is a flange member having a horizontal channel extending therethrough;

a middle portion;

said middle portion is a hollow cylindrical housing having an open top and an enclosed bottom;

an opening extends through said hollow cylindrical housing;

said flange member of said end cap is snuggly received within said open top of said middle portion and said channel is aligned with said opening;

a locking device is located within said opening and said channel for locking and securing said end cap to said open end of said middle portion;

an orifice extends through said enclosed bottom of said middle portion;

a bearing is housed within said middle portion;

an elongated shank having a first end and a second end is received within said bearing and passes through said orifice;

said first end is received within said bearing and said second end includes a receiving member; and said elongated shank can rotate freely about said middle portion.

2. An attachment device as in claim 1 wherein said bearing is press-fit directly to said cylindrical housing.

3. An attachment device as in claim 2 wherein said middle portion houses said flange member of said top portion and said bearing and said middle portion is free from other obstructions.

4. An attachment device as in claim 1 wherein a hook member is removably secured to said receiving member.

5. An attachment device as in claim 4 wherein a pin is removably secures said hook member to said receiving member.

6. An attachment device as in claim 1 wherein said receiving member located at said second end of said shank is an aperture.

7. An attachment device as in claim 1 wherein said locking device will restrict rotational movement of said middle portion and said end cap.

8. An attachment device as in claim 1 wherein a holding device is removably secured to said receiving member.

9. An attachment device for use with a hoisting unit, said attachment device comprising:

a top portion;

said top portion constitutes an end cap and extending upwardly from said end cap are a pair of elongated flanges disposed parallel and forming a U-shaped configuration forming a centrally located gap between said pair of elongated flanges;

each flange includes an alignable aperture that is adapted to receive a removable locking pin;

extending downwardly from said end cap is a flange member having a horizontal channel extending therethrough;

a middle portion;

said middle portion is a hollow cylindrical housing having an open top and an enclosed bottom;

an opening extends through said hollow cylindrical housing;

said flange member of said end cap is snuggly received within said open top of said middle portion and said channel is aligned with said opening;

a locking device is located within said opening and said channel for locking and securing said end cap to said open end of said middle portion;

an orifice extends through said enclosed bottom of said middle portion;

a bearing is housed within said middle portion;

an elongated shank having a first end and a second end is received within said bearing and passes through said orifice;

said first end is received within said bearing and said second end includes a receiving member; and said elongated shank can rotate freely about said middle portion; and wherein said flange of said top portion will restrict upward movement of said shank.

10. An attachment device as in claim 9 wherein said receiving member located at said second end of said shank is an aperture.

11. An attachment device as in claim 9 wherein a hook member is removably secured to said receiving member.

12. An attachment device as in claim 11 wherein a pin is removably secures said hook member to said receiving member.

* * * * *